US005980241A

United States Patent [19]

Schirneker

[11] Patent Number: 5,980,241

[45] Date of Patent: Nov. 9, 1999

[54] PARAFFIN LAMP

[76] Inventor: Hans-Ludwig Schirneker, Langenbruch 18, D-59581, Warstein, Germany

[21] Appl. No.: 09/000,340

[22] PCT Filed: Jul. 10, 1996

[86] PCT No.: PCT/EP96/03011

§ 371 Date: Jan. 20, 1998

§ 102(e) Date: Jan. 20, 1998

[87] PCT Pub. No.: WO97/04273

PCT Pub. Date: Feb. 6, 1997

[30] Foreign Application Priority Data

Jul. 20, 1995 [DE] Germany ..... 195 26 489

[51] Int. Cl.[6] ..... F23D 3/16

[52] U.S. Cl. ..... 431/291; 431/289; 431/291; 431/292; 431/298; 431/325; 362/161

[58] Field of Search ..... 431/288, 289, 431/292, 291, 298, 325; 362/161

[56] References Cited

U.S. PATENT DOCUMENTS

| | | | |
|---|---|---|---|
| 2,504,584 | 4/1950 | Ramos | 431/325 |
| 2,774,235 | 12/1956 | Ruetz | 431/325 |
| 3,888,620 | 6/1975 | Devon . | |

FOREIGN PATENT DOCUMENTS

| | | |
|---|---|---|
| 0 509 106 | 3/1991 | European Pat. Off. . |
| 36 40 757 | 6/1988 | Germany . |
| 41 20 513 | 12/1992 | Germany . |
| WO 92/08776 | 5/1992 | WIPO . |
| WO 93/16153 | 8/1993 | WIPO . |

*Primary Examiner*—Carroll Dority
*Attorney, Agent, or Firm*—Browdy and Neimark

[57] ABSTRACT

The invention has a container (50) for a fuel (W) with at least a partial cover (55) in which there is a non-combustible wick (52) in a wick holder (100). Above the container (50) near the wick holder there is at least one roller or upright body (RK) or in the container (50) there is a disc of solid fuel (W) around the wick holder (100), whereby the fuel of the roller and upright body (RK) or of the disc is melted by the flame and cover heat and collected by the container (50) and/or by the wick holder (100) as supplementary fuel. The wick holder (100) is suspended in an aperture (56) of the container cover (55), so that the wick holder (100) is not in direct heat-tansmitting contact with the container base (50b).

38 Claims, 15 Drawing Sheets

Figure 1:
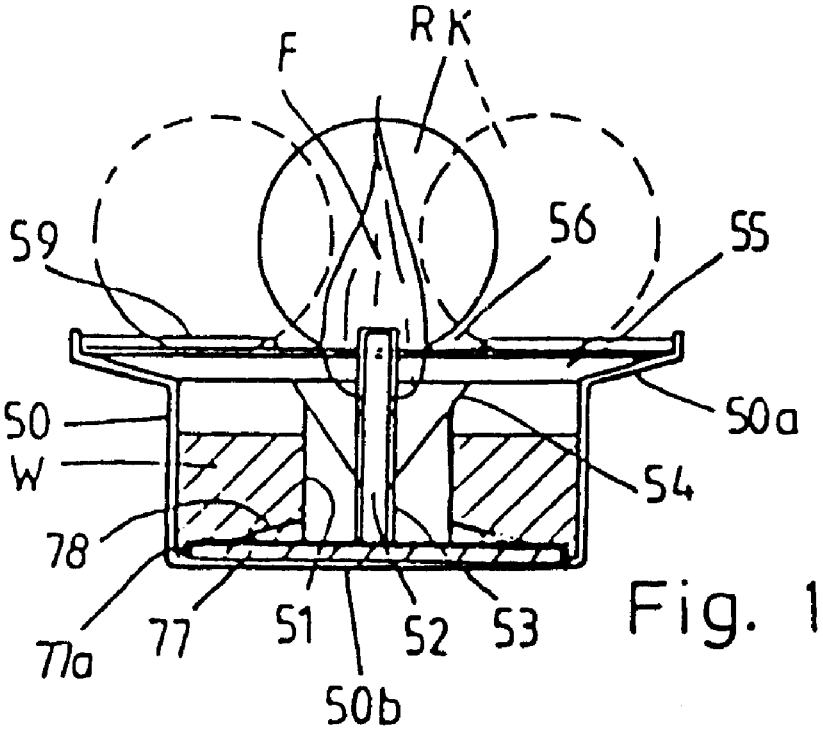

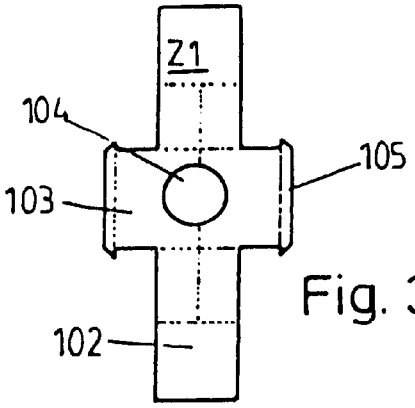
Fig. 34a
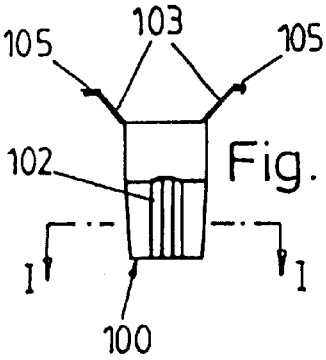
Fig. 34b
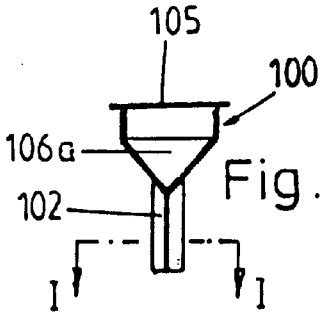
Fig. 34c
Fig. 34d
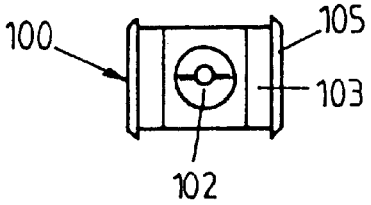
Fig. 34e
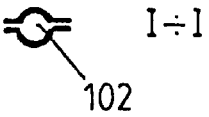
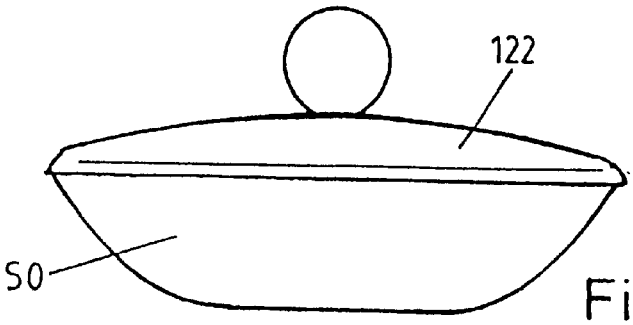
Fig. 35

PARAFFIN LAMP

The invention relates to a paraffin lamp (tea-light and lamp) having a container for a fuel with at least a partial cover, and a non-combustible wick in a wick holder comprising a holder tube for the lower wick section from which funnel segments extend upwards to receive the fuel and transmitted heat; the invention furthermore relates to a non-combustible wick and to the design of the fuel to be burned in the lamp.

It is the object of the invention to improve the above paraffin lamp and its components, namely with respect to

- a compact, space saving and inexpensive design in which a melting of the fuel bodies causes them to alter their shape and which holds a supply of fuel bodies and permits automatic feeding of the fuel bodies to the flame area, as the first object of the invention,
- an uncomplicated and reliably functioning wick holder that can be manufactured cost-effectively, as the second object of the invention,
- a wick with a long glow zone and optimum burning performance made of advantageously designed and combined fiber materials with a specially treated exterior sheath, as the third object of the invention, and
- the fourth object of the invention is a combined effect of the wick and specially designed wick holder (burner) to permanently prevent cracking residue deposits in the entire combustion zone (wick, wick holder and lamp container).

The first object is met according to claim 1 with at least one roller or upright body positioned above the container near the wick holder, or a disc of solid fuel positioned inside the container around the wick holder, so that the fuel of the rollers and upright bodies or of the disc, respectively, is melted by the flame and cover heat and collected by the container and/or the wick holder as supplementary fuel.

The second object is met according to claims 2 and 3 with a wick holder that can be manufactured easily and cost-effectively from a cut template in a bending process and can be easily positioned in the cover of the fuel container. The wick holder is suspended inside the container without direct heat transfer to the container bottom and has a good air conduction and heat transfer to the fuel and an optimum fuel transfer to the wick. Because of openings in its jacket, said wick holder furthermore permits a view of the remaining fuel despite the lamp cover.

The third object is met with the wick formed of twisted quartz fiber glass bundles that are conglutinated either along their exterior sheath or throughout according to claim 4, said wick having good absorption properties and a glow zone that travels downward for a lasting good burning performance of the non-combustible wick. When the wick goes out, it glows downward beyond the clogging-prone zone, i.e., practically up to the funnel end of the wick holder.

The third object is furthermore met with a non-combustible wick according to claim 18 having a core of an absorbing material, preferably quartz glass fibers, and surrounded by a metal wire coil and/or tube of quartz glass, with a gap provided as insulation between the upper combustion zone and the lower pre-heating and suction zone of the wick.

As a result of this gap, the flame is defined and specifically directed at the upper coil area, thus causing the flame to attain its high flame point. In this combustion zone the temperature reaches over 220° C.

On one hand, the described gap prevents the flame from extending downward, so that it continuously remains only in the combustion zone with the high flame temperature, and on the other hand it produces an optimal (long) insulation area for the temperature transition from approx. 80° C. to 220° C. between the pre-heating and suction zone and the combustion zone.

The gap permits a certain thermal conductivity to prewarm the paraffin inside the wick which, however, has no adverse effect on the high flame temperature.

The combustion zone formed by the metal wire coil or the tube and delimited by the gap or insulation, respectively, is relatively long according to the desired height of the flame, so that the high temperatures in the combustion zone are maintained.

The lower part of the metal wire coil or the tube may, in addition to the gap in the coil or in lieu of the gap, also be provided with an insulation layer which has a high flame point and contributes to the definition of the flame but also has no adverse effect on the heat conductivity in the wick needed to prewarm the fuel.

Possible burning residues are completely consumed in the preheating zone because the metal wire coil or quartz glass tube, respectively, become red hot when the flame goes out, at which time the eventual few burning residues are completely consumed. Through holes in the wick holder funnel the extinguishing flame receives enough oxygen to completely consume eventual burning residues. In the process, the metal wire coil or quartz glass tube gradually turns red hot from the top down which causes the complete destruction of the burning residues.

Because of the special design of the incombustible wick and the favorable burning characteristics, the paraffin retains its original color without discoloration.

An incombustible wick of the above type inserted in a paraffin lamp has an advantageously defined flame zone with a high flame temperature, permits a clean and residue-free burning and has a nearly unlimited functionality (life.)

The fourth object is met according to claim 37 with the aid of the fuel which has a composition of carbohydrates with medium-length chains and an admixed glow enhancer which is fed to the wick from the paraffin, resulting in a temperature increase and improved burning in the glow zone when the fuel in the wick is depleted, with the result that the residues are better and completely consumed.

A further object of the invention lies in a special placement of the fuel ball or fuel balls with respect to the wick holder or wick holders on the container or paraffin lamp, respectively, which placement may take a variety of forms and is described in the claims 5 through 14 and 25 through 35.

The paraffin lamp according to the invention is designed as a handy lamp which can be manufactured cost-effectively, has a compact design, can be placed on a table, etc. in a space saving manner and permits a visible melting with altering shape of the fuel bodies. The fuel bodies are placed near or around the flame and then melted by the heat of the flame, resulting in shapes with changing appearance that are pleasant to look at.

With this lamp, a plurality of fuel bodies may be placed directly onto the lamp to attain a longer burning time without having to continuously add fuel bodies. The paraffin lamp may furthermore be provided with a rolling stirrup or supply channel onto which a plurality of fuel bodies may be placed which then automatically roll in the direction of the flame where they are consumed.

Dripping fuel is returned into the lamp container where it creates a fuel supply.

On the lamp container cover, which forms a melting plate onto which the fuel bodies are deposited, an exchangeable glass fiber fleece is placed in an advantageous manner which absorbs dripping fuel until it is saturated, resulting in a smooth, clean surface which makes the lamp container look good and does not cause any adverse effect in the form of burning residues or the like.

A further object of the invention consists of an advantageous shape of the fuel for the wick and lamp that provides for a very simple handling for placing the fuel on the lamp, and an automatic, clean supply of fuel to the flame area of the lamp while preventing soiling of the lamp with lamp fuel.

This object is met with the characteristics of claim 36.

While the solid fuel bodies may have various geometric shapes, they are preferably designed in the shape of rollers.

The fuel balls are furthermore held in place in a fixed position by recesses of star shape or another shape inside spherical receptacle segments in the container cover, so that despite the shifting center of gravity no rotating or tilting of the fuel balls occurs when the paraffin melts.

A further object of the invention regarding a special design of the fuel is met with a fuel disc (fuel tablet) according to claim 16 and 17 which encloses the wick holder and the wick while leaving an air opening, and which provides good melting properties when it is lit.

The wick is lit through the air opening, with the result that paraffin is immediately melted off by the flame and supplied to the wick. The existing (remaining) paraffin segment across from the air opening is relatively large, thus ensuring that the wick will stay lit when ignited.

The remaining claims contain advantageous designs of all the above embodiments of the invention.

The inventive ideas are represented, specifically, by the wick holder, the wick, the fuel, the placement of the wick holder with respect to the fuel, the reception of fuel in a fixed position, the routing of the heat transfer and also in the combination of some or all of the above inventive ideas which, individually and in their partial or complete combination, have resulted in the creation of a paraffin lamp with an increased useful value.

The size of the container (diameter and height) corresponds to that of a normal (large or small) tea-light container and it may be inserted into any normal (conventional) lamp housing.

Figure 2:
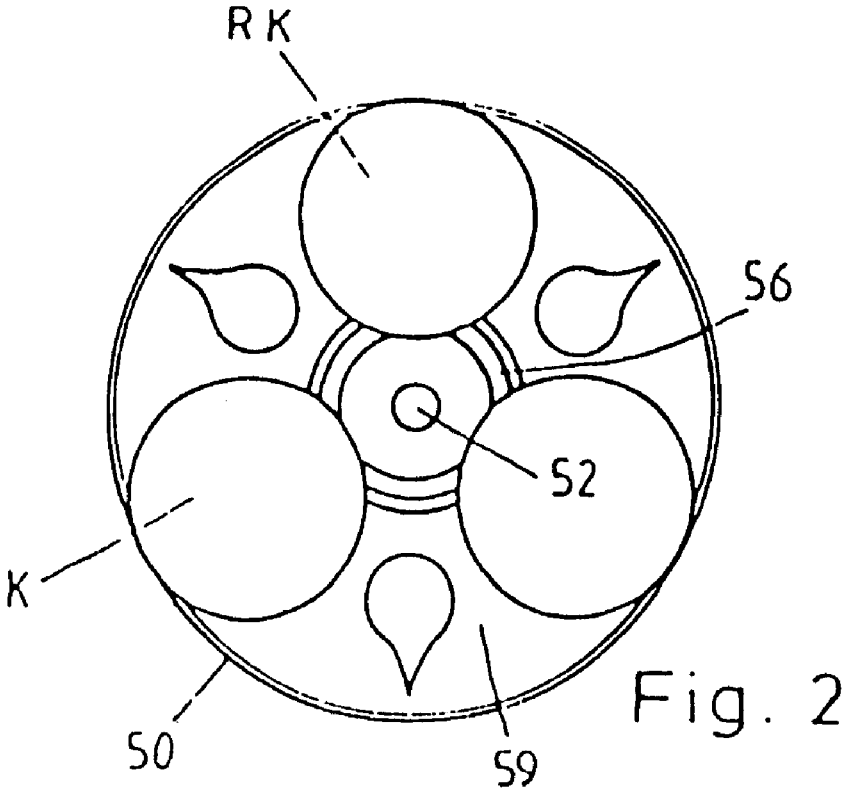
Figure 3:
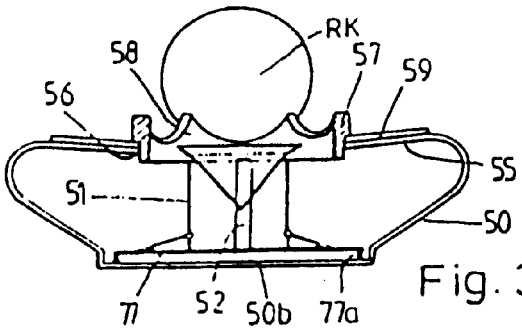
Figure 4:
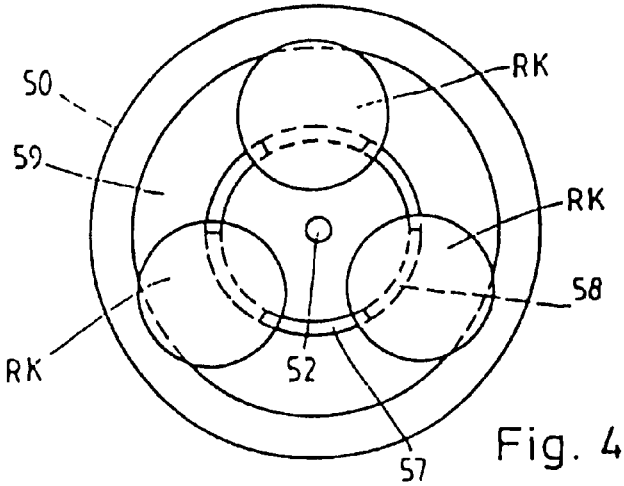
Figure 5:
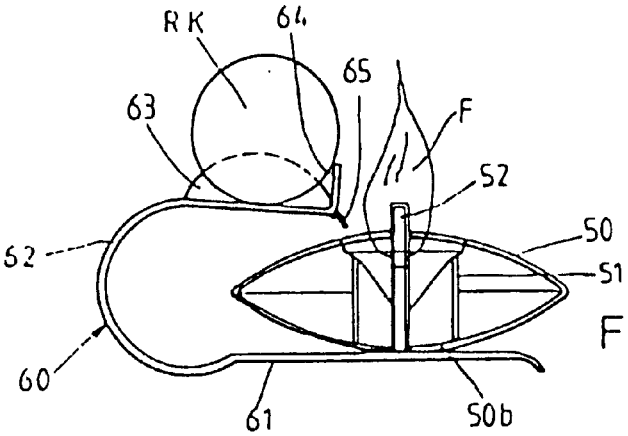
Figure 6:
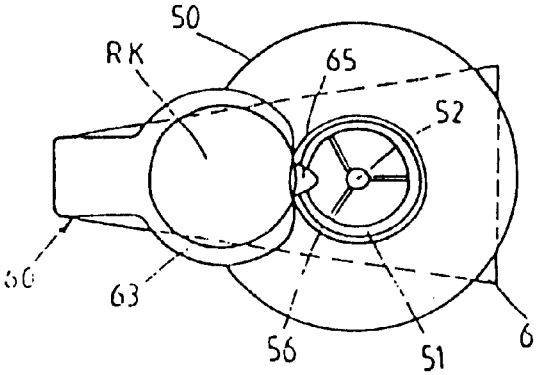
Figure 7:
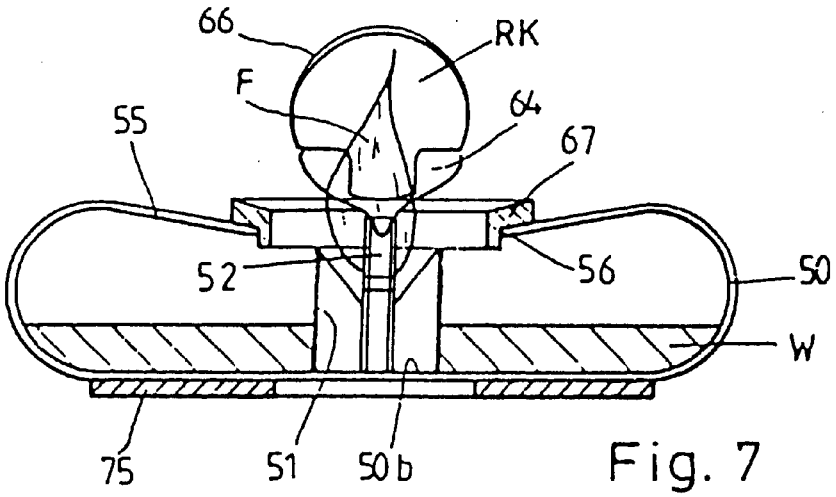
Figure 8:
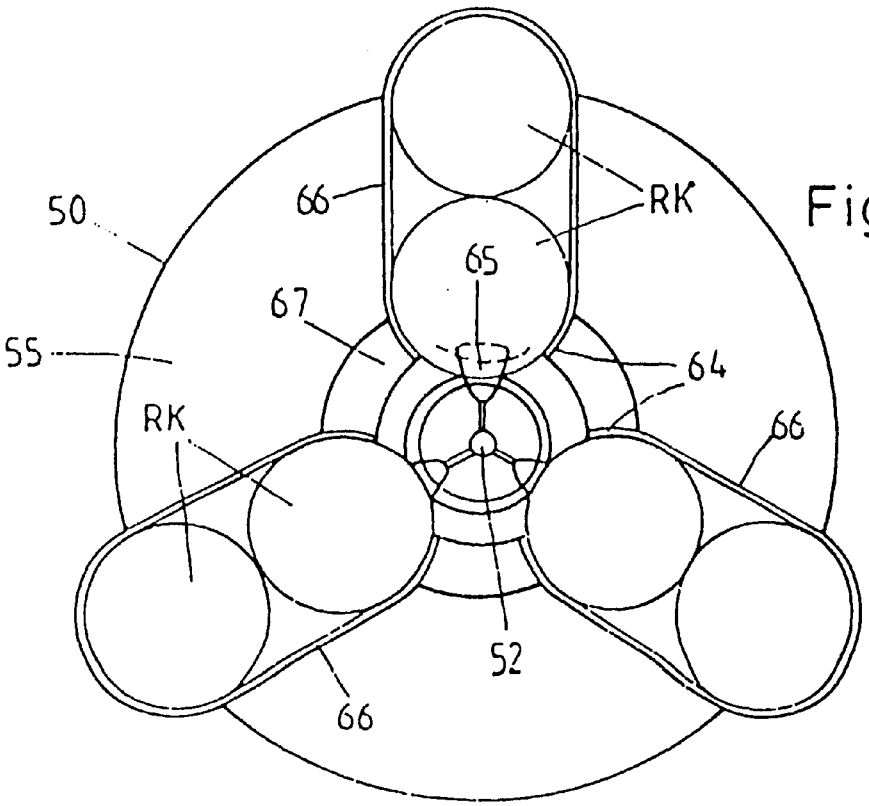
Figure 9:
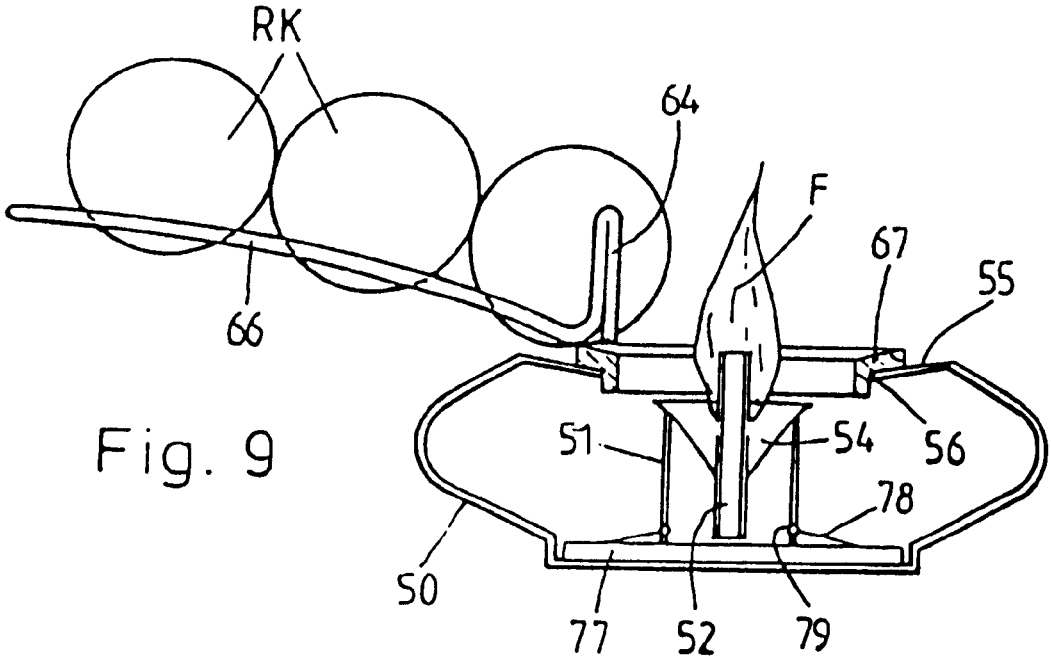
Figure 10:
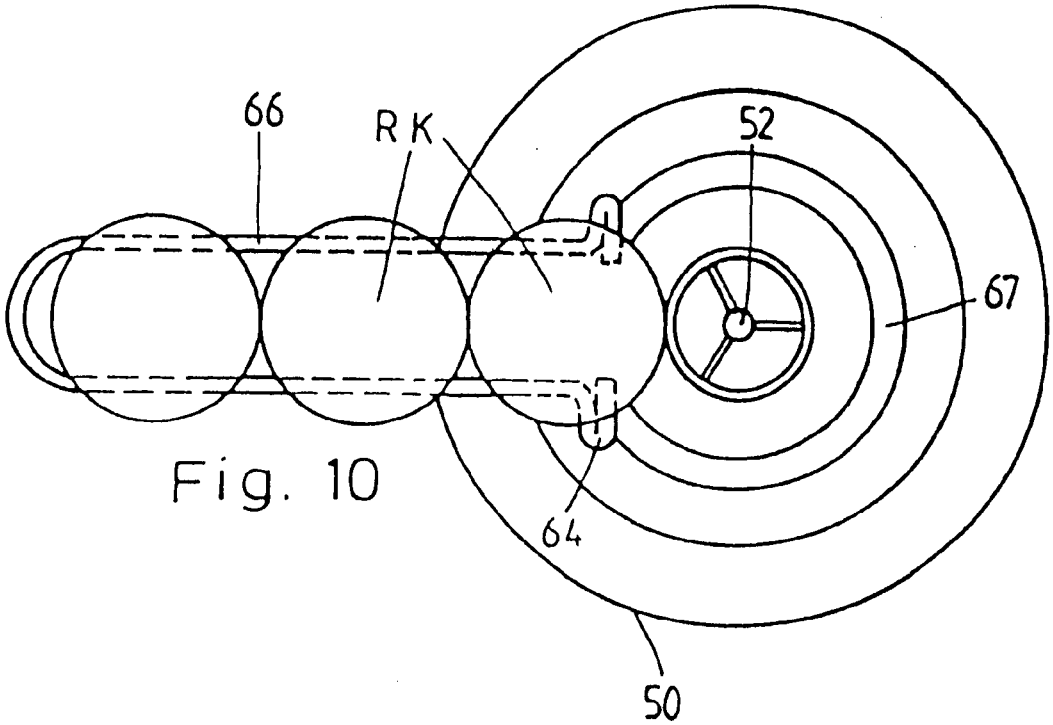
Figure 11:
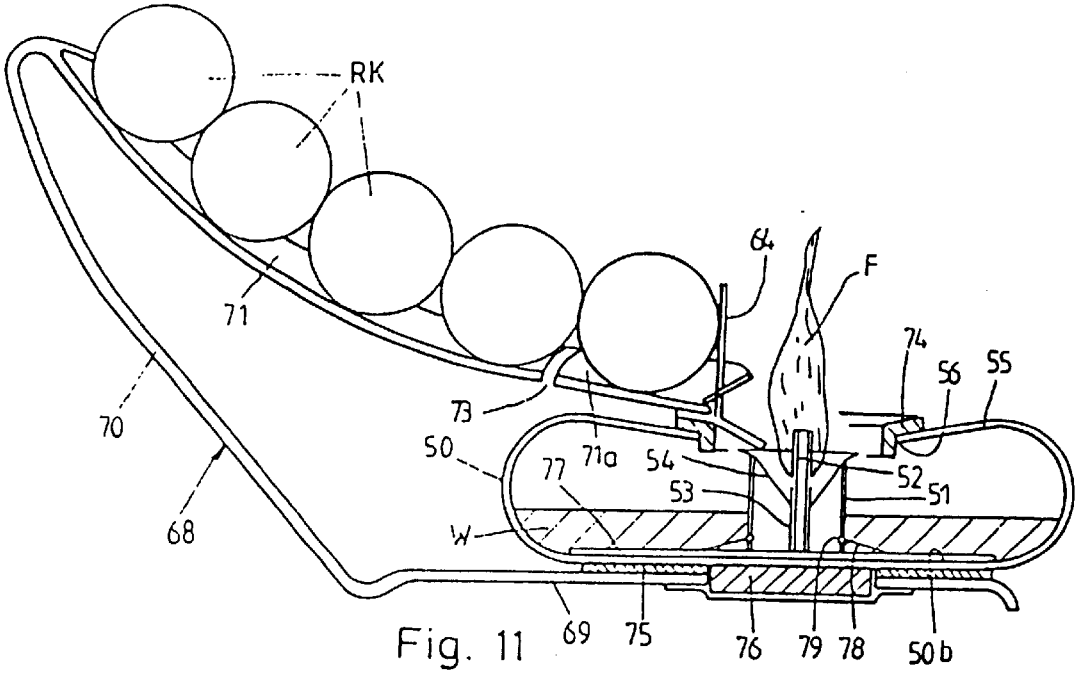
Figure 12:
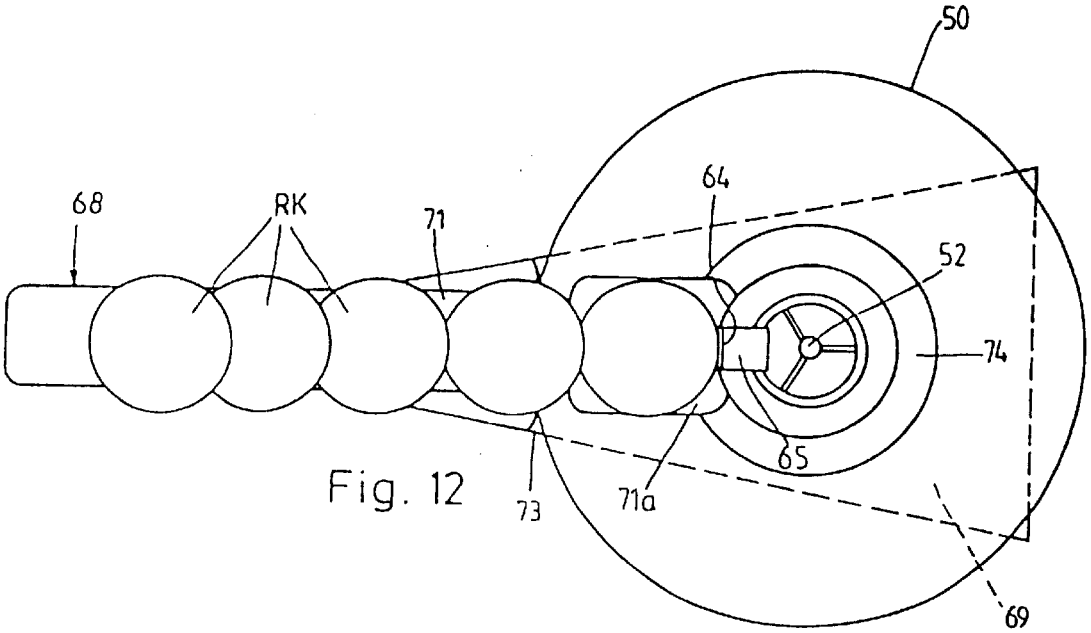
Figure 17:
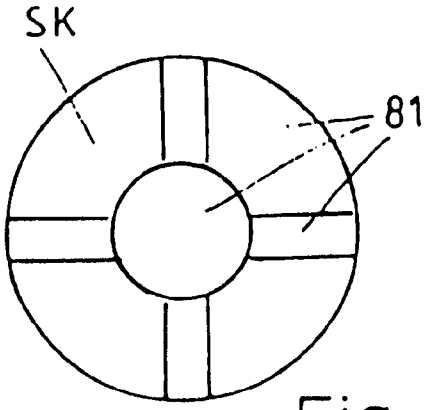
Figure 18:
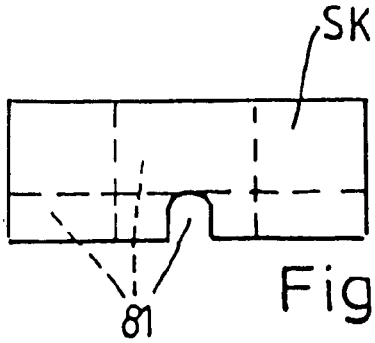
Figure 19:
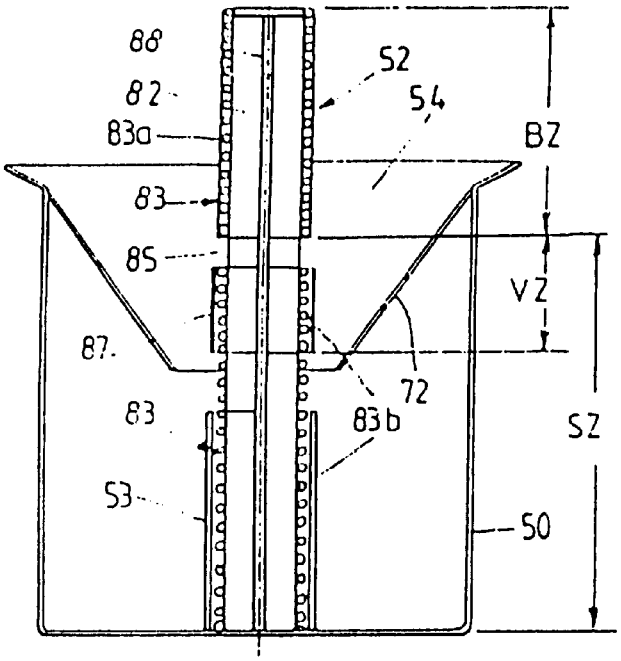
Figure 20:
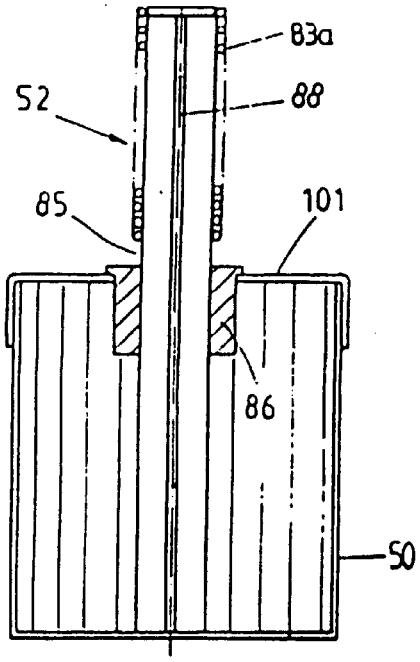
Figure 21:
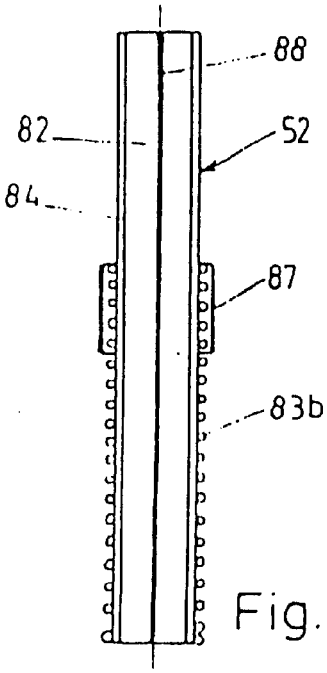
Figure 22:
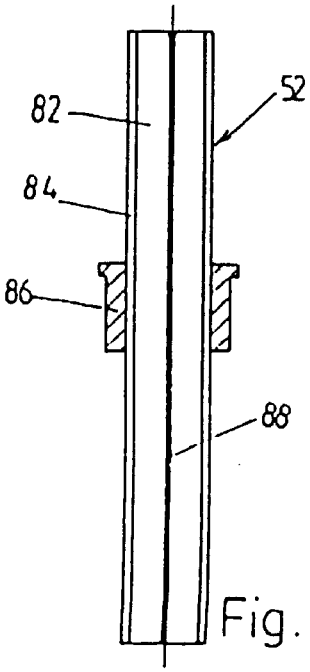
Figure 23:
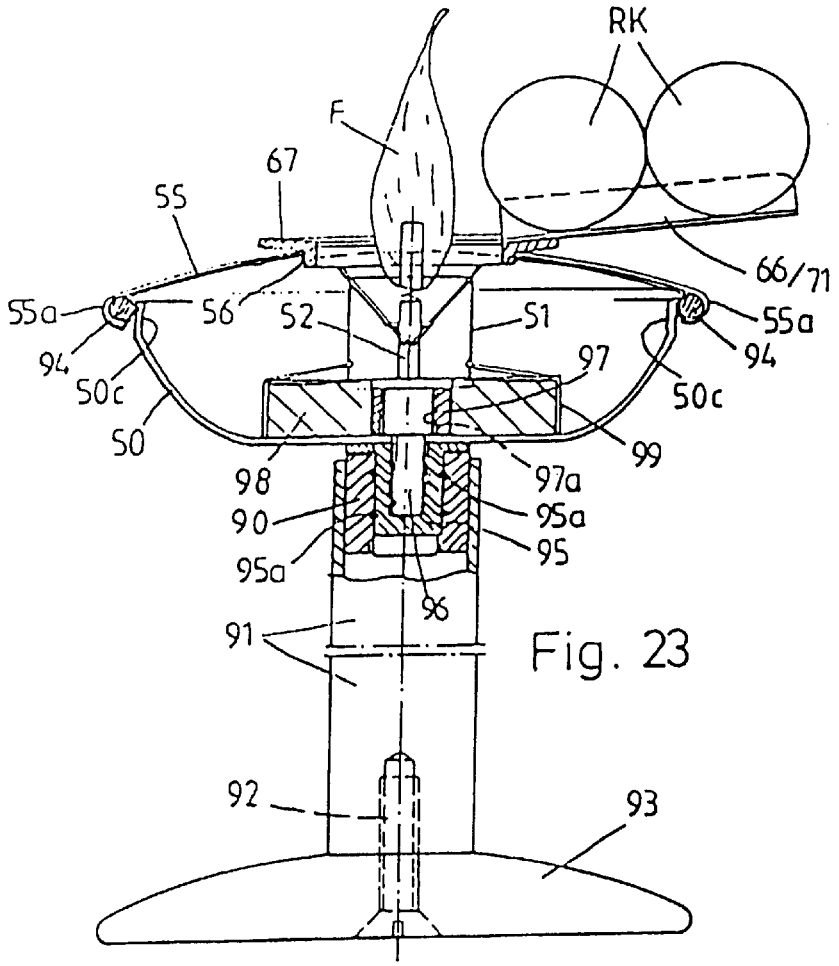
Figure 24:
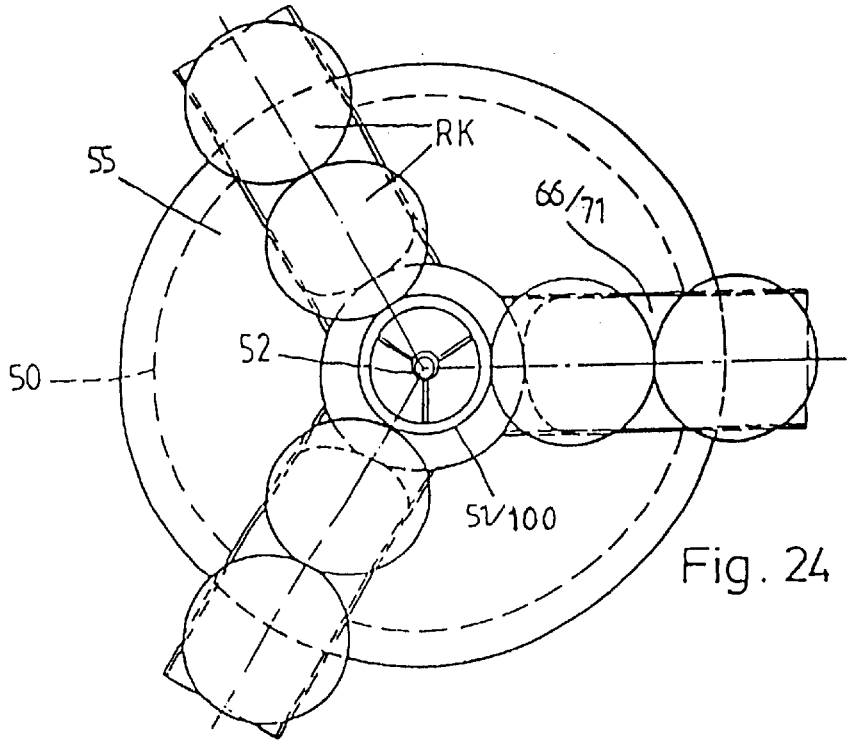
Figure 25:
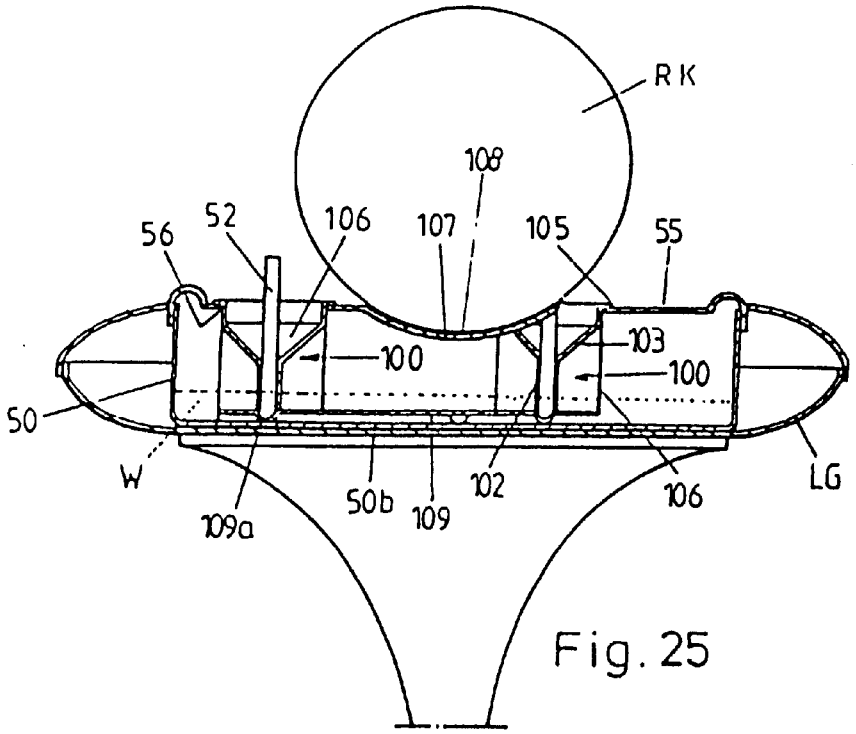
Figure 26:
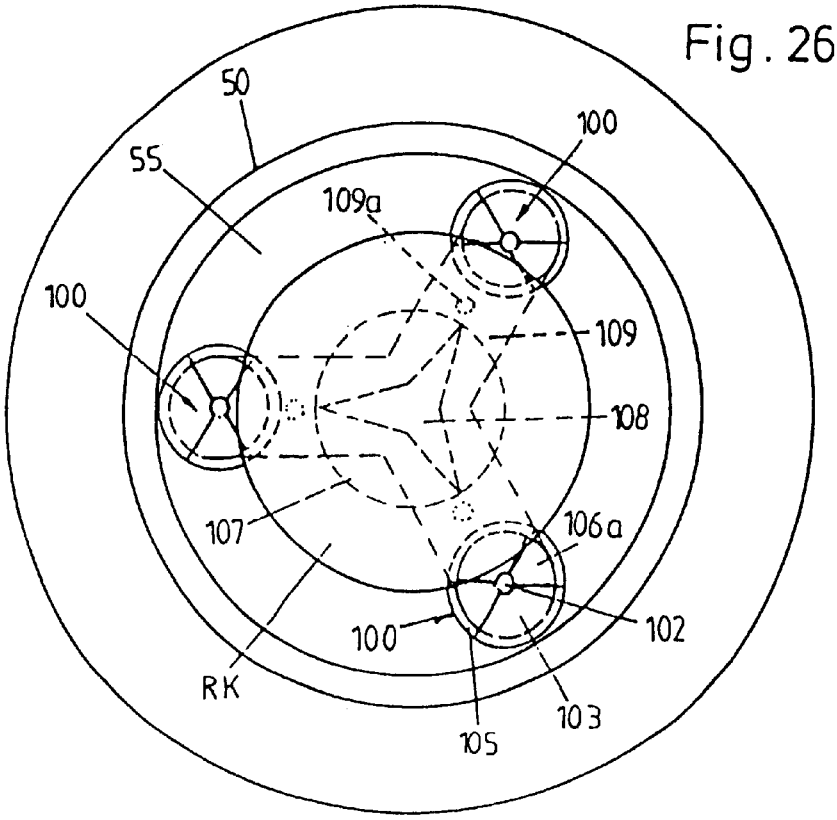
Figure 27:
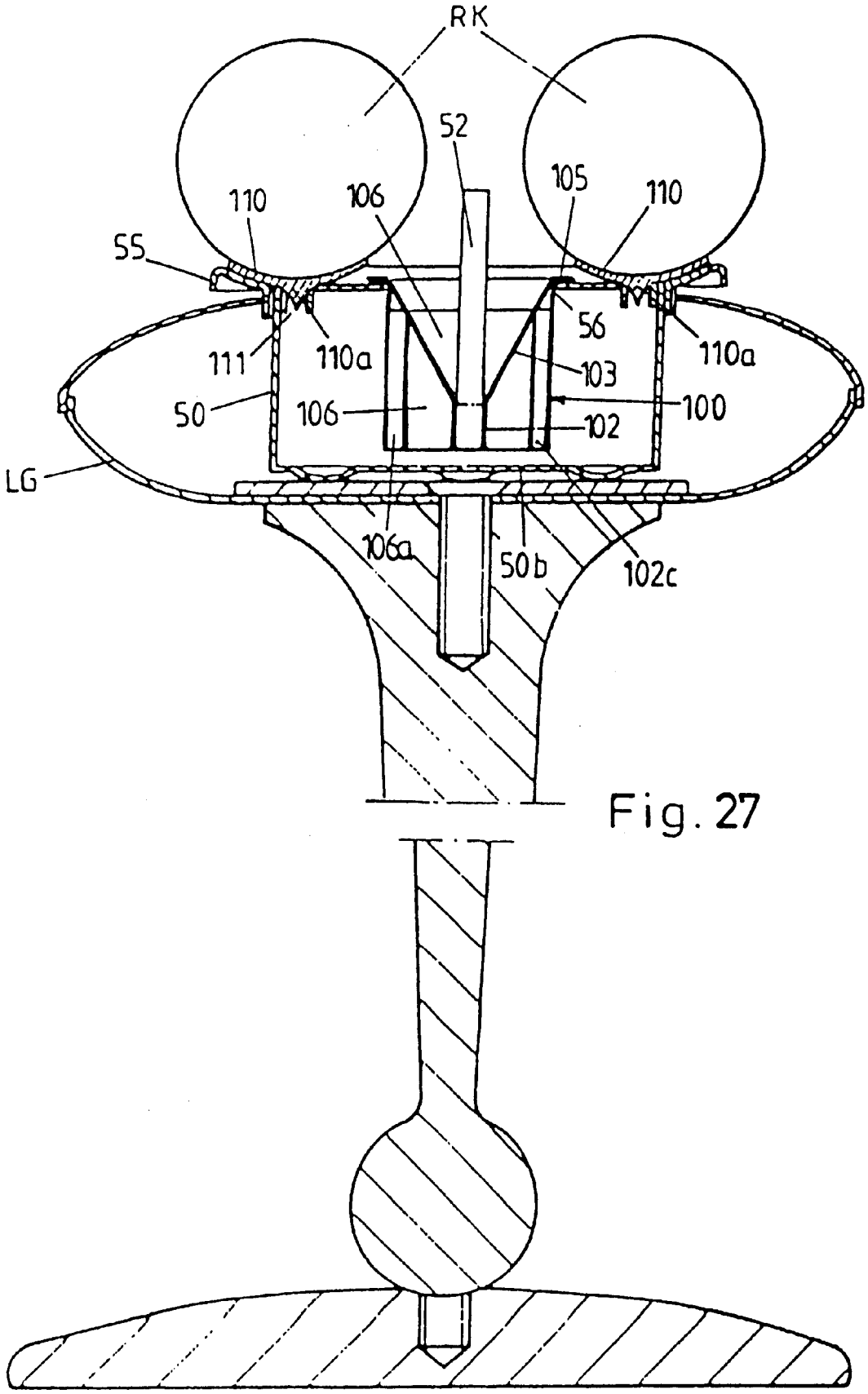
Figure 28:
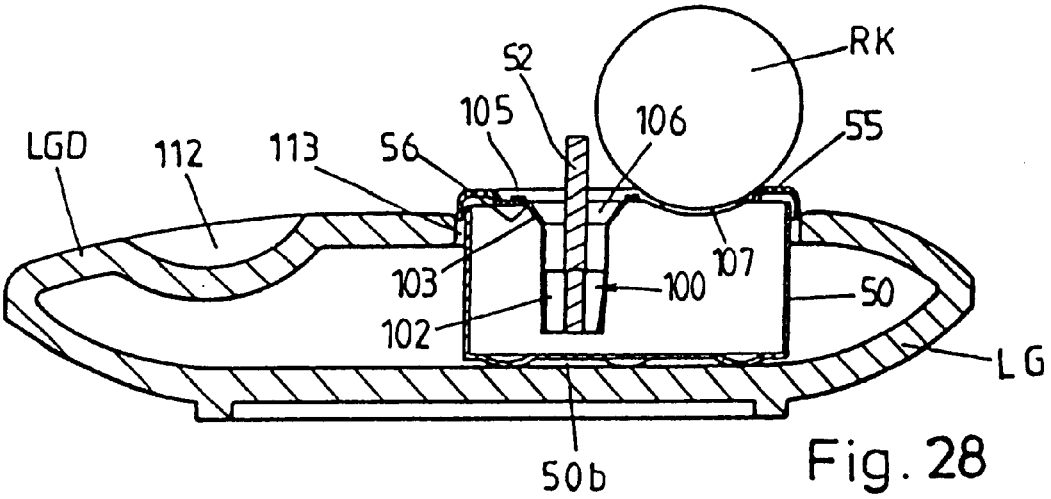
Figure 29:
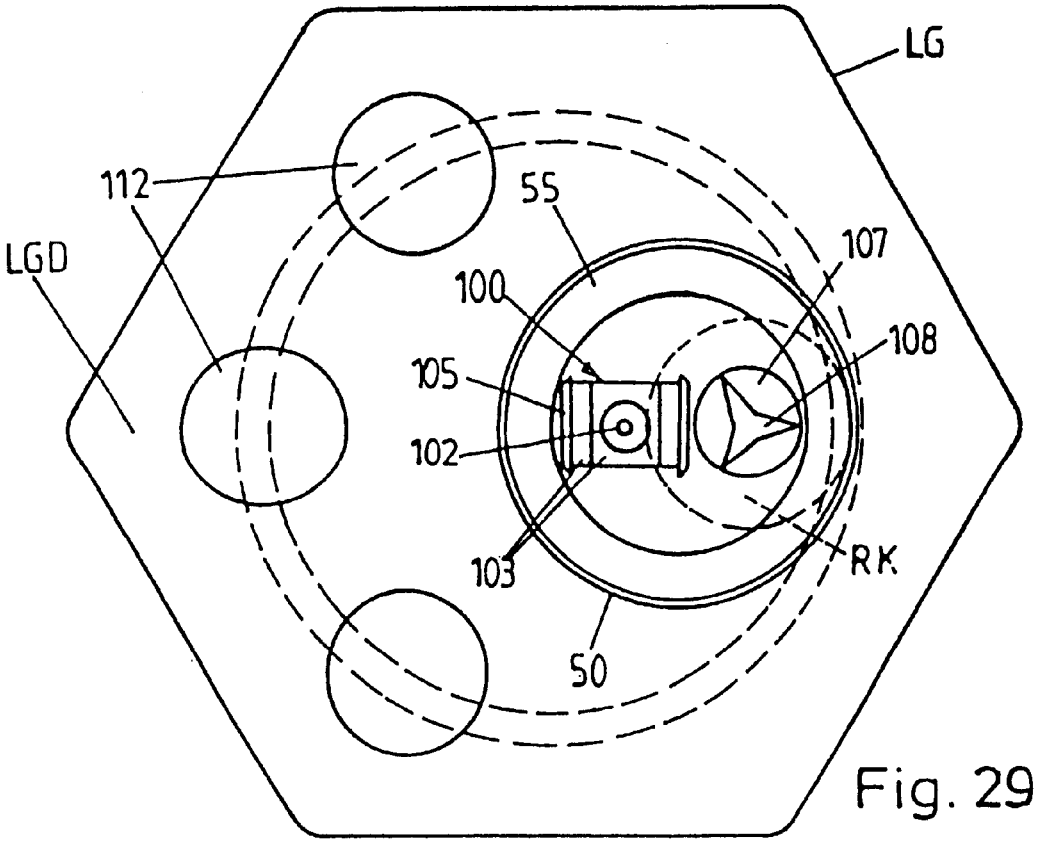
Figure 30:
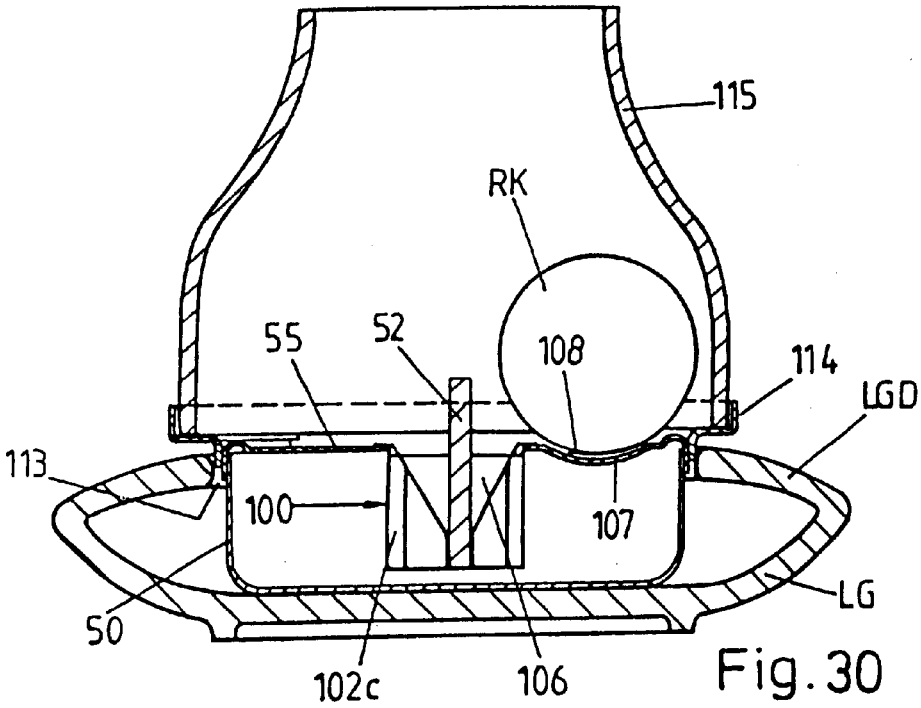
Figure 31:
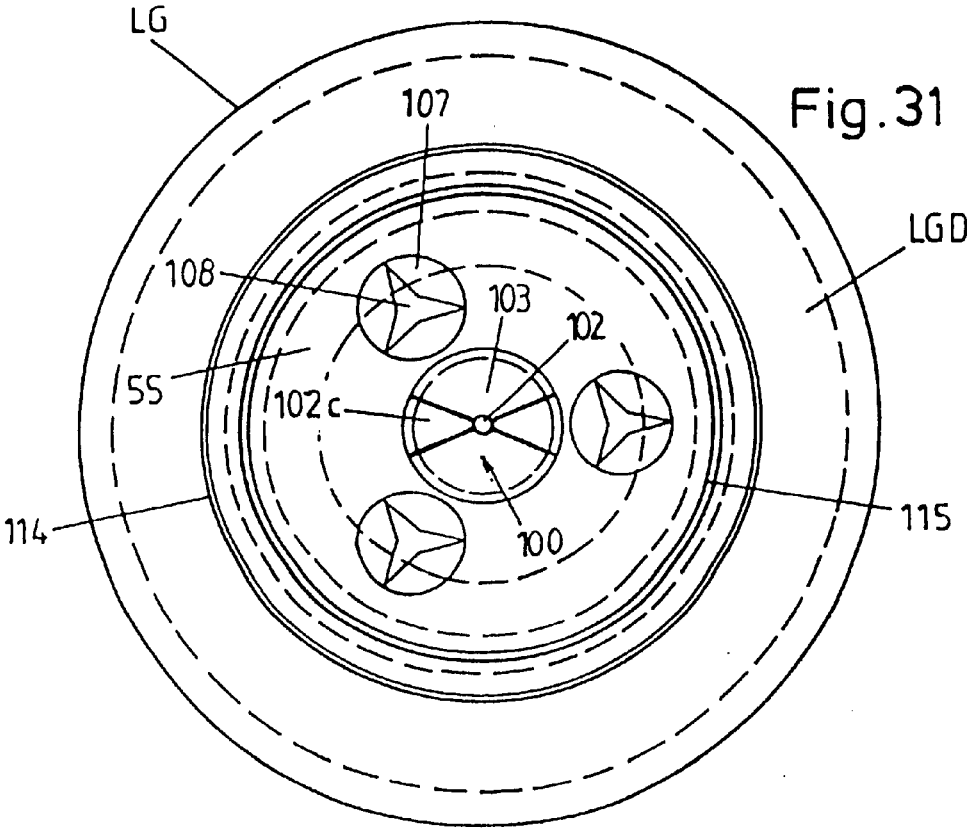
Figure 32:
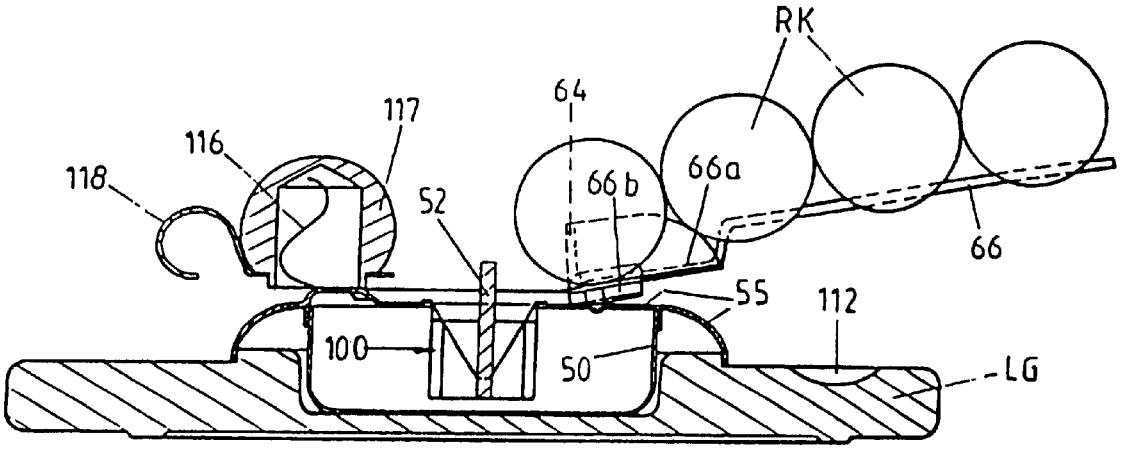
Figure 33:
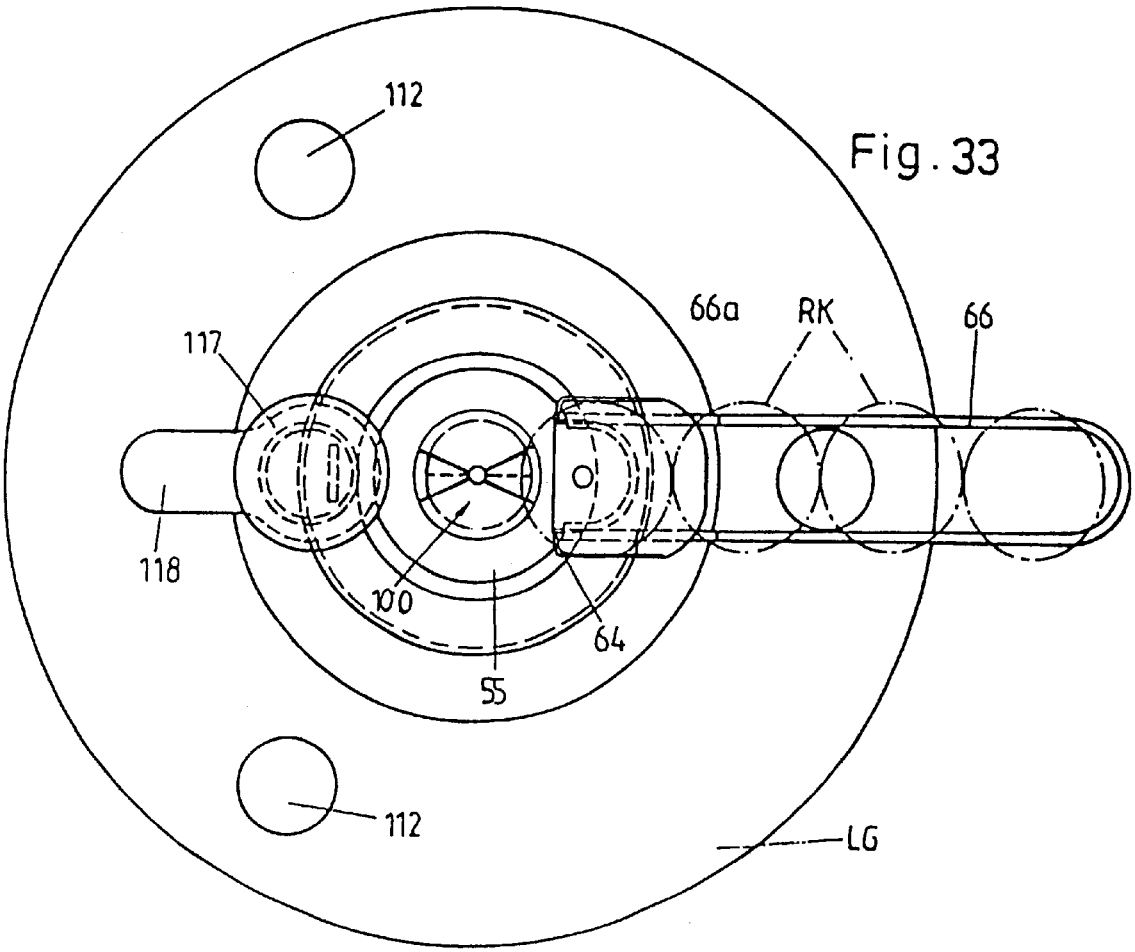

Variations of the example embodiments of the invention are explained in detail below, based on the following drawings in which:

FIGS. 1 and 2 show a vertical section and a top view of a paraffin lamp in the form of a tea-light with a plurality of fuel rollers positioned on a melting plate around an incombustible wick, near the flame, FIGS. 3 and 4 show a vertical section and a top view of a paraffin lamp with a plurality of rollers positioned on a ring insert with rounded stops, FIGS. 5 and 6 show a side view in a partial section and a top view of a paraffin lamp with a lamp holder holding a lamp container and a roller, FIGS. 7 and 8 show a vertical section and a top view of a paraffin lamp with a removable ring body with rolling stirrups, each of which can hold 2 rollers, placed on the lamp container, FIGS. 9 and 10 show a vertical section and a top view of a paraffin lamp with a rolling stirrup removably placed on the lamp container to receive a plurality of rollers, FIGS. 11 and 12 show a vertical section and a top view of a paraffin lamp with a lamp holder with a rolling channel for stored rollers, FIGS. 13 through 18 show side views and a bottom view of rollers and upright bodies of solid fuel in various geometrical shapes FIG. 19 is a vertical section through an incombustible wick with a discontinuous metal wire coil inserted in a wick holder, FIGS. 20 through 22 show side views of the incombustible wick in various designs, FIGS. 23 and 24 show a sectional side view and a top view of a paraffin lamp with a lamp holder, FIGS. 25 and 26 show a vertical section through and a top view of a paraffin lamp with three wick holders suspended inside a paraffin lamp around a large solid fuel ball, FIG. 27 is a vertical section through a paraffin lamp with a central wick holder suspended inside a container and with two solid fuel balls, FIGS. 28 and 29 show a vertical section through and a top view of a paraffin lamp with an exterior container with a suspended wick holder and one solid fuel ball, FIGS. 30 and 31 show a vertical section through and a top view of a paraffin lamp with a central wick holder and three solid fuel balls arranged around same, and a glass cylinder, FIGS. 32 and 33 show a vertical section through and a top view of a paraffin lamp with a central wick holder and solid fuel balls arranged on a rolling channel, and a manually operable flame extinguisher, FIGS. 34*a* through 34*e* show top views, side views and a section along the line I—I in FIG. 33*b* and 33*c* through the one-piece wick holder from the cut template to the finished shape.

Figure 36:
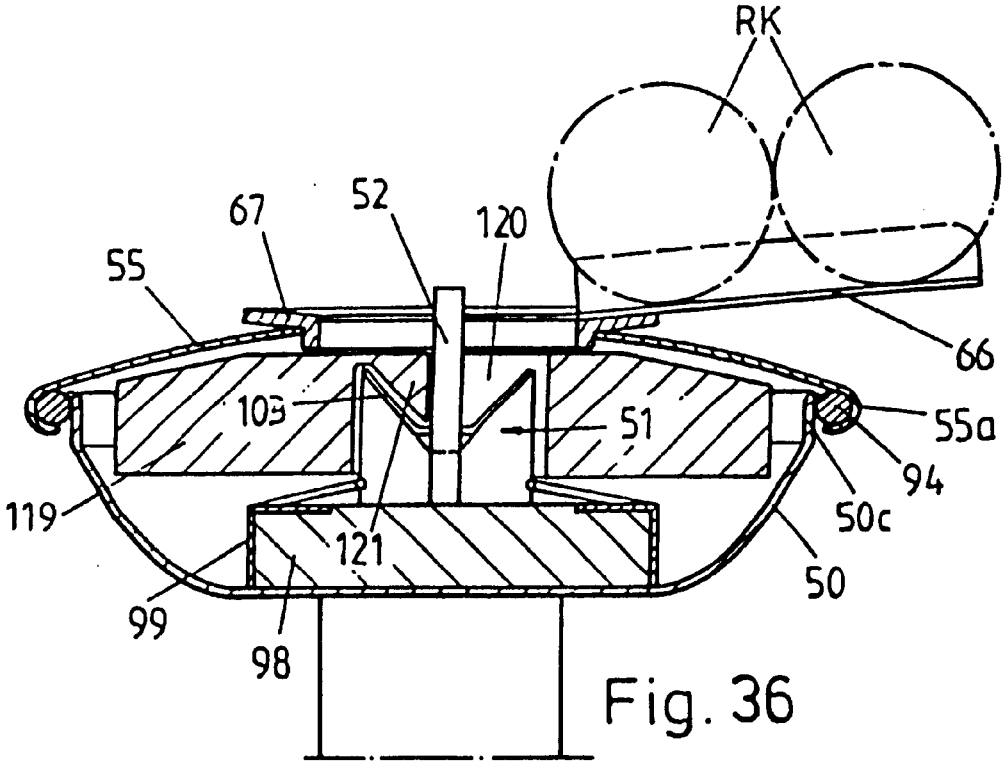
Figure 37:
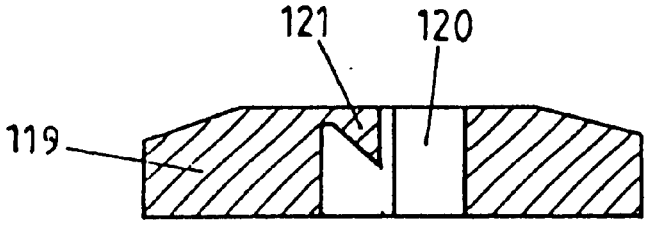
Figure 38:
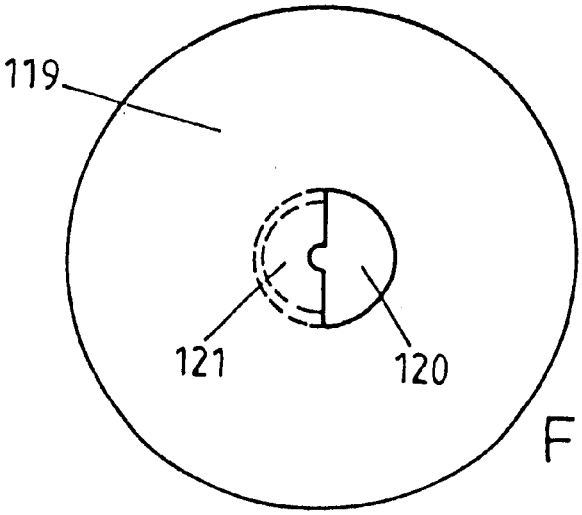

FIG. 35 is a side view of a container with a removable decorative and flame extinguishing cover, FIG. 36 is a vertical section through a paraffin lamp with a solid fuel disc placed around the wick holder inside a container with a central wick holder, FIGS. 37 and 38 show a vertical section through and a top view of the solid fuel disc.

The paraffin lamp has a bowl or pot-shaped container (50) with a combustible wick (52) inside a wick holder (51); whereby the wick holder (51) provides melting heat to the fuel (W) filled into the container (50) and the melted fuel flows to the wick (52). The wick holder (51) is made of thin-walled metal and encloses the wick (52) on all sides, leaving only a supply channel. The wick holder (51) has a cylindrical shape and, at the bottom, a centrical holder tube—cannula—(53), into which the wick (52) is inserted. The upper end of said holder tube (53) widens to form a funnel (54) which extends to the upper edge of the wick holder (51) from which the wick (52) extends upwards.

Positioned above the container (50), near the flame, is at least one roller or upright body (RK, SK) and are preferably a plurality of rollers or upright bodies (RK, SK) made of solid fuel (W), whereby the fuel (W) of said rollers or upright bodies is melted by the heat of the flame and collected by the container (50) and/or the wick holder (51) as supplementary fuel.

A plurality of, preferably three, rollers or upright bodies (RK, SK) may be placed at a distance around the flame (F) on top of the cover (55) of the pot-shaped container (50) designed as a tea-light with a circumferential edge (50*a*) projecting on the outside, said cover (55) forming a melting plate with a centrical flame aperture (56) (FIG. 1 and 2.)

As shown in FIG. 3 and 4, the cover (55) of the container (50) forming a melting plate is designed in the shape of a shallow funnel sloping toward its centrical flame aperture (56), and a ring insert (57) with integral rounded stops (58) for positioning a plurality of, preferably three, rollers (RK) around the flame (F) is removably inserted into the flame aperture (56).

Provided on top of said cover (55) is an exchangeable glass fiber fleece (59) which evenly absorbs dripping fuel until it is saturated, after which excess fuel drips into the wick holder (51) and/or the container (50). As a result, the cover (55) always looks clean.

As illustrated in FIGS. 5 and 6, the paraffin lamp has a lamp holder (60) with a foot (61) to hold the container (50) and a stirrup component (62) extending upwards at a distance to the container (50) and provided with a positioning receptacle (63) in the form of a pocket located above the container (50) for a roller or upright body (RK, SK); said positioning receptacle (63) having a catch (64) to hold the roller or upright body (RK, SK) at a distance from the flame (F) and a drip nose (65) for the melted fuel dripping back into the container (50) or into the wick holder (51).

In the further embodiment of the paraffin lamp as shown in FIG. 7 through 10, the cover (55) of the container (50) is designed as a shallow funnel sloping toward its centrical flame aperture (56); and a ring insert (67) with one or a plurality of rolling stirrups (66) to hold a supply of two or a plurality of rollers (RK) is removably inserted in the flame aperture (56), each rolling stirrup (66) having an integral retainer catch (64) at a distance from the flame (F). Each rolling stirrup (66) may also be provided with a drip nose (65).

The paraffin lamp according to FIGS. 11 and 12 has a lamp holder (68) with a foot (69) to hold the container (50), and a lamp holder stirrup (70) which extends upwards and outward from the lamp holder foot (69), and a rolling channel (71) for a plurality of rollers (57) which curves or slopes downward from the upper end of the lamp holder stirrup (70) toward the flame aperture (56) in the cover (55) of the container (50), said rolling channel (71) having a retainer catch (64) at a distance from the flame (F) for the respective first roller.

The rolling channel (71) is separated, between the first roller (RK) closest to the flame and the following second roller (RK), by a slit (73) to interrupt the heat transfer.

The separated channel section (71*a*) for the first roller (RK) is removably inserted into the flame aperture (56) with a ring insert (74). Attached to said separated channel part (71*a*) are a retainer catch (64) designed in the form of a bridge or the like and a drip nose (65) for the fuel dripping into the container (50) and/or the wick holder (51).

A heat insulation layer (75) may be placed between the foot (61, 69) of the lamp holder (60, 68) and the bottom (50*b*) of the container (50) (FIG. 11), and a heat insulation layer may also be provided under the container (50) according to FIG. 7 which may be operated without the lamp holder, and under the tea-light according to FIG. 1.

The container (50) is held in place with a magnet (76) on the foot (61, 69) of the lamp holder (60, 70) acting on the container bottom (50*b*).

The cover (55) may be a removable separate part inserted in the container (50) or formed as one piece with the container (50).

The steeper the rolling stirrup (66) or the rolling channel (71), the faster the fuel material (W) melts off, because of the pressure caused on the roller (RK) closest to the flame by the following rollers (RK). If the rolling stirrup or rolling channel are attached at a small incline, the lamp fuel (W) is melted off more slowly.

The wick holder (51) is detachably connected to a holder plate (77) placed on the container bottom (50*b*) and designed with integral tongues (78) which engage in cutouts (79) of the wick holder (51).

As shown in FIGS. 1 and 3, the holder plate (77) is designed as a hollow plate with a circumferential dropped edge (77*a*) to hold the holder plate (77) at a certain distance above the container bottom (50*b*) and there also is fuel (W) between the holder plate (77) and the container bottom (50*b*) to supply the wick (52).

FIGS. 23 and 24 show a further variation of the paraffin lamp in which the same reference numerals have been used for the same components.

The container (50) is supported by a vertical lamp holder (91) with a foot (93). The container (50) has a removable cover (55) with a seal (94) in the form of an O-ring placed inside a circumferential groove (55*a*) of the cover, and said cover (55) removably encompasses the upper, preferably cylindrical edge section (50*c*) of the container (50), and thus seals the container.

Inserted into the upper end of the vertical lamp holder (91) is an insert (90) of plastic, rubber, or the like, into which a flange sleeve (95) of metal or the like presses with integral projections (95*a*) or is screwed with a thread, into which flange sleeve (95) a head bolt (96) is screwed with a thread hole (97*a*) provided in its head (97) to hold the container (50) in place on the lamp holder (91).

Inside the container (50) a felt ring (98) is placed around the head (97) of the head bolt (96) and encompassed by a metal cap (99) carrying the wick holder (51).

The paraffin lamp represents a lamp which may optionally be used in two different ways. One way is to operate the lamp with paraffin by inserting into the lamp a ring tablet of paraffin filling almost the entire container; and the other way is to operate the lamp with paraffin rollers (RK).

In both cases the wick holder (51) and wick are provided on the metal cap (99) of the container (50).

The circumferential cover seal (94) prevents liquefied paraffin from being spilled when the lamp is moved and set down.

Figure 13:
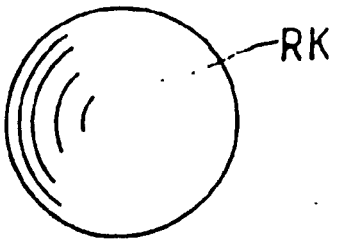
Figure 14:
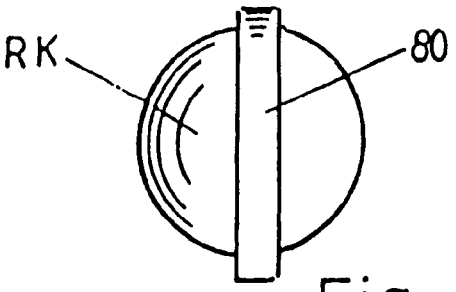
Figure 15:
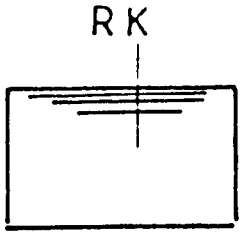
Figure 16:
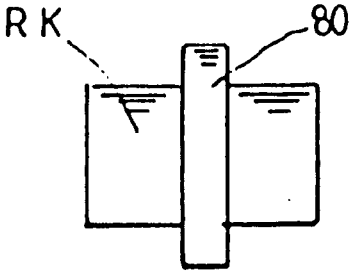

FIG. 13 through 18 show various sample embodiments of the roller or upright body (RK, SK); the roller (RK) may be formed as a ball (FIG. 13) or cylinder (FIG. 15) with or without a circumferential collar (80)—FIGS. 14 and 16—and the upright body (SK)—FIGS. 17 and 18—may be formed as a block, rod or disc with air channels (81).

If the roller (RK) is formed as a ball or cylinder with a collar (80) according to FIG. 14 and 16, said collar (80) may be guided between the rolling stirrup (66).

The upright bodies (SK) may have a variety of three-dimensional geometric shapes, e.g., the shape of a dice, pyramid, triangle, polygon or oval.

Reference is now made to the incombustible wick (52) as shown in FIG. 19 through 22, which is specifically designed for use in the above described paraffin lamps.

Said wick (52) comprises a core (82) made of a heat resistant fiber material, preferably quartz glass fiber, and is encompassed by a metal wire coil (83) and/or tube (84) of quartz glass; the wick has a circular cross-section.

The metal wire coil (83) or the tube (84) are at least partially separated and/or provided with a heat insulation (85, 87) in the longitudinal direction of the wick to reduce the heat transfer between the combustion zone (BZ) located at the upper end and the pre-heating and suction zone (VZ, SZ) at the lower end.

The gap (85) in the metal wire coil (83) is located within the funnel (54) formed at the upper end of the wick holder (51).—FIG. 19.

The coil (83) is divided into two sections, with an upper coil (83*a*) extending along the combustion zone (BZ) with windings located above one another at a distance to one another and a closed coil at the upper end of the wick. These windings of the coil, which are not tightly spaced, permit a quick ignition.

The coil (83) furthermore has a lower (second) coil (83*b*) which extends from the gap (85) along the preheating and suction zone (VZ, SZ) and may have the same winding as the upper coil (83*a*) or a tighter winding.

The metal wire coil may be provided with a fireproof insulation layer (87) of lacquer, glass, ceramics, or the like, applied by spraying, dipping or depositing around a partial area of the lower metal wire coil (83), starting at the gap.

The insulation layer (87) settles into the narrow windings of the coil (83) and produces an optimized heat insulation to the outside.

Placed around the upper end of the wick core (82), as shown in FIG. 20, is a metal wire coil (83*a*) and, extending from the gap (85) an insulating body (86) of an insulating material with a high flame point, preferably made of porcelain, plastics, melamine, or the like, which is inserted into a sheet steel cap (101) which receives heat to pre-soften the fuel (W).

The wick core (82) as shown in FIG. 21 is made of an absorbing, textured material, preferably quartz glass, and enclosed along its entire length by a smooth tube (84) of non-textured material, preferably quartz glass; a metal wire coil (83*b*) is provided around the tube (84) in the area of the preheating and suction zone (VZ, SZ), which metal wire coil is also enclosed by a fire-proof insulating layer (87) along a portion of its length to reduce the heat transfer.

As shown in FIG. 22, the wick core (82) may be enclosed by a tube (84) along its entire length, around a partial length of which tube a fire-proof insulating body (86) with a high flame point is provided in the area of the preheating and suction zone (VZ, SZ) to interrupt the heat transfer.

A heat-conducting copper wire (88) extending along the entire length of the wick (52) and stabilizing same, is integrated in the wick core (82) according to a preferred method.

The copper wire (88) is rod or tube-shaped.

To obtain the tube shape, the wire may be formed into a tube from a flat material or into a tube coil from wire, so that a capillary tube results which provides an absolutely free suction zone in the core of the wick (52).

The funnel (54) in the wick holder (51) has holes (72) through which the paraffin can flow down into the container (50). Because of the poor heat conductivity of the wick (52), a good glow-out is also ensured without holes (72).

Because of the insulation layer (87) or insulating body (86), respectively, the flame (F) cannot jump over downward to the wick (52).

At the same time, the insulation layer (87) or insulating body (86), respectively, forms a transition zone from the warm (hot) to the cooler (cold) wick area.

The paraffin lamp (tea-light and lamp) according to FIG. 25 through 38 has a pot or bowl-shaped container (50) to receive a fuel (W)—paraffin/wax—with a cover (55) at least partially covering said container (50) in which is provided an incombustible wick (52) inside a wick holder (100/51), said wick holder (100/51) showing a holder tube (102) for the lower wick section from which funnel segments (103) extend upwards to receive fuel and radiating heat.

The wick holder (100) is suspended in an aperture (56) of the container cover (55) in a manner so that there is no direct heat transfer to the container bottom (50*b*).

The wick holder (100) is made of one piece from a cross-shaped cut template (Z1) of very thin sheet steel, aluminum sheet metal or the like with a centered hole (104), as shown in FIG. 10*a,* and is formed into the holder tube (102) located at the lower end and two opposite funnel segments (103) with hanger edges (105) projecting on the outside at their upper ends, as shown in FIG. 34*a* through 34*e*.

In a further preferred embodiment, the wick holder (100) is formed as a single piece from a thin, rectangular cut template of approximately 52×18.5 mm.

The funnel segments (103) form a widening funnel (106) that extends upwards from the holder tube (102).

Openings (shafts) (106*a*) are left free between the funnel segments (103) of the wick holder (100) (along their circumference or on opposite sides) to permit a view of the amount of fuel remaining in the container (50) and permit a heat radiation of the fuel residue remaining in the container (50) when the wick is lit without adding solid fuel balls (RK).

The wick is made with a copper wire center and textured quartz fibers and the quartz fibers are conglutinated along their exterior sheath or throughout with a fireproof and glow-proof binder.

The textured fibers are loosened for an improved absorbency. The core of the wick (copper wire) and the wick sheath (quartz fibers) together have a diameter of approximately 1.7 to 2.5 mm, preferably 2.4 mm.

Because of the suspended wick holder (100), the wick (52) has a glow zone that travels downward to a point near the end of the funnel.

The design of the wick holder (100) with the segments (102*b,* 103) provides for a favorable heat transfer and distribution to the cover (55). The good heat transfer to the cover (55) results in a complete melting of the paraffin.

The edge of the wick holder is cooler because of the heat emission, so that paraffin located there is not gasified and no residue is formed.

According to the embodiment of the lamp shown in FIG. 25 and 26, a spherical receptacle segment (107) is provided in the center of the cover (55) for a large solid fuel ball (RK), and around said spherical receptacle segment (107) three equally spaced wick holders (100) are suspended in cover apertures (56); in the spherical receptacle segment (107) formed by the cover (55), a star-shaped or differently shaped recess (108) is provided to hold the fuel balls (RK) in place and keep them from rotating.

A tripod-shaped heat conducting sheet steel (109) which is in contact with the bottom parts of the three wick holders (100) to transfer heat is provided inside the container and supported on the container bottom (50*b*) on a point loading (with minimal contact areas—109*a*—) under prevention of a greater heat transfer.

According to the embodiment of the lamp shown in FIG. 27, a central wick holder (100) suspended in the container cover (55) has two assigned spherical receptacle segments (110) snapped into the cover (55) across from one another for two solid fuel balls (RK). Because of the good heat transfer to the cover (55), the paraffin is completely melted. The spherical receptacle segments (110) engage into the holes (111) in the cover (55) with plug-type snap-in prongs (110*a*).

The fuel balls (RK) are elevated by the spherical receptacle segments (110) and supported by the edge of the spherical receptacle segments while they are melting, so that a rotating of the balls is prevented.

FIGS. 28 and 29 show a lamp having a wick holder (100) suspended non-centrically on one side of the container cover and a spherical receptacle segment (107) with a star-shaped recess (108) to hold the fuel ball (RK) in a fixed position and prevent it from rotating on the other side of the container cover.

The container (50)—tea-light—is inserted non-centrically into a lamp housing (LG) and the cover (LGD) of the lamp housing (LG) has a plurality of spherical receptacle segments (112) for magazined solid fuel balls (RK).

FIGS. 30 and 31 show a paraffin lamp with a wick holder (100) suspended in the center of the container cover (55); formed in the container cover (55), at an equal distance around the wick holder (100) and to each other are three spherical receptacle segments (107), each with one star-shaped recess (108) to hold the solid fuel balls (RK) in place in a fixed position and prevent them from rotating.

Said container (50) is placed into a lamp housing (LG); and provided around the container cover (55), between the container cover (55) and the aperture (113) of the lamp housing cover (LGD), is a plug-in ring (114) to receive a glass cylinder (115).

According to the embodiment of the lamp as shown in FIGS. 32 and 33, a centered wick holder (100) is suspended in the container cover (55); said wick holder (100) having a rolling channel (66)—rolling stirrup—sloping or curving downward and provided with a melting tub (66*a*) for a plurality of fuel balls (RK) attached on one side, and a plug-on holder (116) with a removable hat-shaped flame extinguisher (117) with a handle (118) on the other side.

The melting pan (66*a*) has a retainer catch (64) for the first solid fuel ball (RK). The rolling stirrup (66) is insulated with respect to the melting pan (66*a*), the container cover (55), and the container (50) with an insulation (66*b*) to protect against heat transfer.

In the paraffin lamp according to FIG. 36, a disc (119) of fuel—a fuel disc—is placed in the container (50) around the wick holder (51).

The container (50) according to FIG. 36 has a removable cover (55) with a seal (94) in the form of an O-ring placed in a circumferential groove (55*a*) and said cover (55) removably encompasses, with said seal (94), the upper, preferably cylindrical edge section (50*c*) of the container (50), thus sealing the container.

Inserted in the center of the cover (55) is a ring insert (67) in the form of a shallow funnel, forming a wick and flame aperture (56) and holding the rolling stirrup (66).

The wick holder (51) is held in place on a felt ring (98) inside the container (50) by a metal cap (99).

The fuel disc (fuel tablet) (119) partially encloses the wick (52) while leaving an air opening (120).

The fuel disc (11) has a circular basic shape and a thickness corresponding to a proportion of the disc diameter; a semi-circular air opening (120) is formed in the center of the disk, and across from same a semi-circular disc segment (121) encompassing one funnel segment (103) of the wick holder (51) and enclosing half of the wick cross-section, as shown in FIGS. 12 through 14.

The paraffin lamp according to FIG. 36 represents a combination device which may optionally be operated with a fuel disc (119) or fuel balls (RK).

The fuel (W)—paraffin—has a solid or liquid admixed or applied glow enhancer to facilitate the glow-out of the wick and remove cracking residue from the wick capillaries (52).

The glow enhancer is added to the paraffin by percentages of weight.

The glow enhancer consists of sulfur, red phosphor, magnesium or the like.

The paraffin has a very narrow melting point range of, for example, 54 to 56° C. and consists of medium-length carbohydrate chains.

In mixtures of carbohydrate chains, the short-chain carbohydrate chains melt sooner and the longer chains melt only partially, causing paraffin residue to remain on the cover (55).

These shortcomings are prevented with the use of medium-length chains.

A small fuel ball (RK) has a weight of preferably 7.5 g, which corresponds to half a tea-light.

Components which are the same in the various lamp designs have been marked with the same reference numerals without a renewed description, and the respective initial descriptions should be consulted.

I claim:

1. In a paraffin lamp comprising a container (e.g. 50) for a fuel, at least partially covered by a cover (e.g. 55), inside of which is provided an incombustible wick (e.g. 52) inside a wick holder (e.g. 53, 100), the lamp further being adapted to receive a body of solid fuel which is positioned to be melted by heat from a flame and from the heated cover, and wherein at least one of the container (50) and the wick holder (100) is adapted to hold melted fuel to be taken up by said wick and burned, the improvement wherein at least one semi-spherical receptacle segment forming a solid fuel-holding recess (e.g. 108) is arranged above the container (50) in the cover (55) near to the wick or above the cover (55), said semi-spherical receptacle segment being shaped to accept the body made of solid fuel as a ball (RK), or wherein at least one roller channel (e.g. 66, 71) with a retainer catch (e.g. 64) is arranged above the cover (55) near to the wick, said roller channel (66, 71) being shaped to receive the body of solid fuel in the shape of a ball (RK).

2. A paraffin lamp according to claim 1, characterized in that the wick holder (100) is suspended in an aperture (56) of the container cover (55) in a manner so that there is no direct heat transfer to the container bottom (50*b*).

3. A paraffin lamp according to claim 1, characterized in that the wick holder (100) is formed from a cross-shaped cut template (Z1) with centered hole (104) as a single piece with a holder tube (102) at the lower end from which two opposite funnel segments (103) extend upwards and form a funnel (106), said funnel segments having, at their upper ends, hanger edges (105) projecting on the outside (FIGS. 34*a* through 34*e*).

4. A paraffin lamp according to claim 1, characterized in that the wick (52) comprises a copper wire core and textured quartz glass fibers and that the quartz glass fibers are conglutinated with a fireproof and glow-proof binder, either in an exterior sheath thereof or throughout.

5. A paraffin lamp according to claim 1, characterized in that said semi-spherical receptacle segment (107) to receive a large fuel ball (RK) is formed in the center of the cover (55) and that two or a plurality of equally spaced wick holders (100) are suspended in the cover aperture (56) around this semi-spherical receptacle segment (107) along a graduated circle (56) (FIGS. 25 and 26).

6. A paraffin lamp according to claim 1, characterized in that a recess is formed inside the semi-spherical receptacle segment (107) in the cover (55) to hold the fuel ball (RK) in place and prevent it from rotating.

7. A paraffin lamp according to claim 1, characterized in that a tripod-shaped heat conducting sheet metal (109) is provided in the container (50) which is in contact with the bottom parts of three wick holders (100) to transfer heat, and has small supporting surfaces (109*a*) with a point loading on the container bottom (50*b*) (FIGS. 25 and 26).

8. A paraffin lamp according to claim 1, characterized in that two opposite semi-spherical receptacle segments (110) which are snapped into the cover (55) to hold two fuel balls (RK) are assigned to a central wick holder (100) suspended in the container cover (55) and hold the fuel balls (RK) at a distance above the cover (55).

9. A paraffin lamp according to claim 1, characterized in that the container cover (55) has a non-centrically suspended wick holder (100) on one side and said semi-spherical receptacle segment (107) on the other side, the latter having a recess (108) to hold a fuel ball (RK) in place and prevent it from rotating (FIGS. 28 and 29).

10. A paraffin lamp according to claim 9, characterized in that the container (50) for fuel is placed non-centrically in a lamp housing (LG) and that a plurality of said semi-spherical receptacle segments (112) for magazined fuel balls (RK) are formed in the cover (LGD) of the lamp housing (FIGS. 28 and 29).

11. A paraffin lamp according to claim 1, characterized in that said semi-spherical receptacle segments (107) are arranged in the container cover (55) around a wick holder (100) suspended in the container cover (55) at an equal distance to each other and to the wick holder (100), each semi-spherical receptacle segment having a recess (108) to hold the fuel balls (RK) in place and prevent them from rotating (FIG. 30 and 31).

12. A paraffin lamp according to claim 11, characterized in that the container (50) for fuel is placed into a lamp holder (G) and a plug-in ring for a glass cylinder (115) is inserted around the container cover (55), between the container cover (55) and the aperture (113) of the lamp housing cover (LGD).

13. A paraffin lamp according to claim 1, characterized in that a central wick holder (100) is inserted in the container cover (55), wherein said roller channel (66) is sloped or curved and has a melting pan (66*a*) and said retainer catch (64) for a plurality of fuel balls (RK), said roller channel (66) being insulated against heat transfer with respect to the melting pan (66*a*), the container cover (55) and the container (50) (FIGS. 32 and 33).

14. A paraffin lamp according to claim 1, characterized in that a snap-on holder (116) holding a removable, hat-shaped flame extinguisher (117) with a handle (118) is provided (FIGS. 32 and 33).

15. A paraffin lamp according to claim 1, characterized in that a removable decorative and flame extinguishing cover (122) is placed on the container (50) (FIG. 35).

16. A paraffin lamp according to claim 1, characterized in that a solid fuel disc (fuel tablet) (119) to be placed in the container (50) encloses the wick holder (51) and a portion of the wick (52) while forming an air opening (120) inside the wick holder (51) (FIGS. 36 through 38).

17. A paraffin lamp according to claim 16, characterized in that the solid fuel disc (119) has a circular basic shape and a thickness corresponding to a proportion of the disc diameter and a semi-circular air opening (120) in the center of the disc, and across from same a semi-circular disc segment (121) encompassing one funnel segment (103) of the wick holder (51) and enclosing half of the wick cross-section (FIGS. 36 through 38).

18. A paraffin lamp with an incombustible wick (52) having a core (82) of a heat-resistant fiber material, preferably quartz glass fibers, and encompassed by a metal wire coil (83) and/or tube (84) of quartz glass, characterized in that the metal wire coil (83) and or the tube (84) are at least partly separated and/or provided with a heat insulation (86, 87) in the longitudinal direction of the wick to reduce the heat transfer between the combustion zone (BZ) at the upper end and the preheating and suction zone (VZ, SZ) at the lower end (FIGS. 19 through 22).

19. A paraffin lamp according to claim 18, characterized in that a gap (85) in the metal wire coil (83) is located within a funnel (54) provided with holes or slits (72) for the paraffin to flow off, which funnel is formed at the upper end of a wick holder that holds, at its lower end, the wick (52) inside a holder tube (53) adapted to also hold the fuel (W) (FIG. 19).

20. A paraffin lamp according to claim 18, characterized in that the coil (83) of the wick (52) is separated into two parts, with an upper coil (83*a*) extending along the combustion zone (BZ) with spaced-apart windings and a closed winding at the upper end of the wick, and a lower coil (83*b*) extending along the preheating and suction zone (VZ, SZ) having the same or tighter windings (FIG. 19).

21. A paraffin lamp according to claim 19, characterized in that a fireproof insulation coating (87) of lacquer, glass or ceramics is applied on a portion of the metal wire coil (83), starting at the gap (85) (FIGS. 19 and 21).

22. A paraffin lamp according to claim 18, characterized in that a metal wire coil (83*a*) is provided around the upper end of the wick (52), and an insulating body (86) with a high flame point, preferably made of plastics, melamine, or the like, which is inserted in a sheet metal cap (101) designed to receive heat to pre-soften the fuel (W) is provided extending from the gap (85) (FIG. 20).

23. A paraffin lamp according to claim 18, characterized in that the wick core (82) is made of an absorbing, textured material, optionally quartz glass, which is enclosed by a tube (84) of non-textured material, optionally quartz glass, along its entire length, and in that a metal wire coil (83*b*) is provided around the tube (84) in the area of the preheating and suction zone (VZ, SZ) and enclosed along a portion of its length by said fireproof insulating layer (87) of lacquer, glass or ceramics (FIG. 21).

24. A paraffin lamp according to claim 18, characterized in that the wick core (82) is enclosed, along its entire length, by a tube (84), around a partial length of which said fireproof insulating body (86) is provided in the area of the preheating and suction zone (VZ, SZ) (FIG. 22).

25. A paraffin lamp according to claim 1, characterized in that the cover of the container (50) for fuel which has a circumferential edge section (50*a*) projecting toward the outside and is designed in the form of a tea-light, forms a melting plate and has a centrical flame aperture (56) and holds a plurality of, optionally three, rollers or upright bodies (RK, SK) at a distance around the flame (F) (FIGS. 1 and 2).

26. A paraffin lamp according to claim 1, characterized in that the cover (55) of the container (50) forming a melting plate is formed as a shallow funnel that slopes towards a centrical aperture (56) therein; and that a ring insert (57) with integral protruding rounded stops (58) is removably inserted into the flame aperture (56) to position a plurality of fuel balls (RK) around the flame (F) (FIGS. 3 and 4).

27. A paraffin lamp according to claim 1, characterized in that an exchangeable glass fiber fleece (59) is provided on the cover (55), covering the entire cover (55), to absorb dripping fuel (FIGS. 1 through 4).

28. A paraffin lamp according to claim 1, characterized by a lamp holder (60) with a foot (61) to hold the container (50) and a stirrup component (62) extending upwards around the container (50) at a distance from the container, having a positioning receptacle (63) above the container (50) in the form of a pocket for a fuel ball (RK), said positioning receptacle (63) having said catch (64) adapted to hold a fuel ball (RK) at a distance from the flame (F), and a drip nose (65) for the melted fuel (W) falling back into the container (50) and/or into the wick holder (51) (FIGS. 5 and 6).

29. A paraffin lamp according to claim 1, characterized in that the cover (55) of the container (50) forms a shallow funnel sloping towards a centrical flame aperture (56), and that a ring insert (67) carries at least one said rolling channel (66), each said rolling channel having a length sufficient to hold at least two fuel balls (RK), said ring insert being removably inserted in the flame aperture (56), each of the rolling channels (66) having a said integral retainer catch (64) (FIGS. 7 through 10).

30. A paraffin lamp according to claim 1, characterized by a lamp holder (68) with a foot (69) to hold the container (50), and a lamp holder stirrup (70) extending outward and upward from the foot (69), and said roller channel (71) for holding a plurality of fuel balls (RK) curving or sloping downward from the upper end of the lamp holder stirrup (70) toward a flame aperture (56) in the cover (55) of the container (50) (FIGS. 11 and 12).

31. A paraffin lamp according to claim 30, characterized in that the roller channel (71) is separated into a first portion and a second portion to interrupt the heat transfer, with the first portion of the channel (71*a*) having a removably inserted ring insert (74) in the flame aperture (56) of the cover (55) of the container (50), and a drip nose (65) for the fuel falling into the container (50) and/or the wick holder (51).

32. A paraffin lamp according to claim 1, characterized in that a heat-insulation layer (75) is provided between a the foot (61, 69) of the lamp holder (60, 68) and the bottom (50*b*) of the container (50) and that the container (50) is held in place on the foot (61, 69) of the lamp holder (60, 68) with a magnet (76) acting on the container bottom (50*b*) (FIG. 11).

33. A paraffin lamp according to claim 1, characterized in that the container (50) has a removable cover (55) with a seal (94) in the form of an O-ring in a circumferential groove (55*a*) in the cover (55) and that the cover (55) encompasses, with its seal (94), the upper, optionally cylindrical edge section (50*c*) of the container (50), thus sealing the container (FIG. 23).

34. A paraffin lamp according to claim 33, characterized in that an insert (90) of plastic or rubber, is inserted in an upper end of a vertical lamp holder (91), to which a flange sleeve (95) is either fastened with projections (95*a*) on the flange sleeve (95) that press into the insert (90) or screwed in with a thread, into which flange sleeve (95) is screwed a head bolt (96) holding the container (50) on the lamp holder (91) with a felt ring (98) which is encompassed by a metal cap (99) carrying the wick holder (51) provided around a head (97) of the head bolt (96) (FIG. 23).

35. A paraffin lamp according to claim 1, characterized in that the wick holder (100) is formed as a single piece from a thin, rectangular sheet steel template with a size of approx. 52×18.5 mm.

36. A paraffin lamp according to claim 1, characterized in that the size of the container (50) corresponds (in its diameter and height) to a normal tea-light container and is adapted to be inserted into normal lamp housings (LG).

37. A paraffin lamp with a paraffin fuel according to claim 1, characterized in that said fuel is in the form of a roller (RK), in the shape of a ball, with or without a circumferential collar (80).

38. A paraffin lamp with fuel according to claim 37, characterized in that a glow enhancer to facilitate the glow-out of the wick and cleaning of the wick capillaries from cracking residue is admixed to the paraffin fuel (W).

* * * * *